United States Patent [19]

Kessler

[11] Patent Number: 4,458,399

[45] Date of Patent: Jul. 10, 1984

[54] INK ROLLER ASSEMBLY WITH CAPILLARY INK SUPPLY

[75] Inventor: John R. Kessler, West Carrollton, Ohio

[73] Assignee: Monarch Marking Systems, Inc., Miamisburg, Ohio

[21] Appl. No.: 521,616

[22] Filed: Aug. 8, 1983

Related U.S. Application Data

[62] Division of Ser. No. 322,459, Nov. 18, 1981, Pat. No. 4,416,201.

[51] Int. Cl.[3] ..... B41L 27/28

[52] U.S. Cl. ..... 29/148.4 D; 29/455 R; 101/348; 101/367; 118/259; 118/DIG. 15; 400/202.4; 400/470; 400/661.3; 427/428

[58] Field of Search ..... 101/348, 329, 331, 367; 29/110, 125, 129.5, 123, 130, 282, 148.4 D, 355 R; 118/259, DIG. 15; 400/202.4, 470, 471, 471.1, 661.3; 427/428

[56] References Cited

U.S. PATENT DOCUMENTS

| | | | |
|---|---|---|---|
| 2,663,257 | 12/1951 | Dudis | 101/327 |
| 3,066,603 | 12/1962 | Talarico | 101/367 |
| 3,134,327 | 5/1964 | Sebanc | 101/331 |
| 3,738,269 | 6/1973 | Wagner | 101/367 |
| 3,814,054 | 6/1974 | Tajihi | 101/348 X |
| 4,270,454 | 6/1981 | Gill et al. | 101/348 |
| 4,311,509 | 1/1982 | Reader et al. | 29/125 X |

*Primary Examiner*—Edgar S. Burr
*Assistant Examiner*—Moshe I. Cohen
*Attorney, Agent, or Firm*—Jacox & Meckstroth

[57] ABSTRACT

A rigid plastic tube supports an ink applying sleeve of resilient micro-porous ink retaining material, and a pair of end journal and closure members are pressed into opposite ends of the tube. An ink retaining unit confined within the support tube between the end closure members and includes axially spaced thin plastic discs which define therebetween ink retaining capillary chambers for receiving a supply of ink. A series of axially spaced holes are formed in the support tube and control the outward radial flow of ink from the capillary chambers into the micro-porous sleeve. In one form, the thin plastic discs are separately formed of molded and include axially projecting hub portions which interfit and provide for pressing a stack of the discs together to form the ink retaining unit.

7 Claims, 5 Drawing Figures

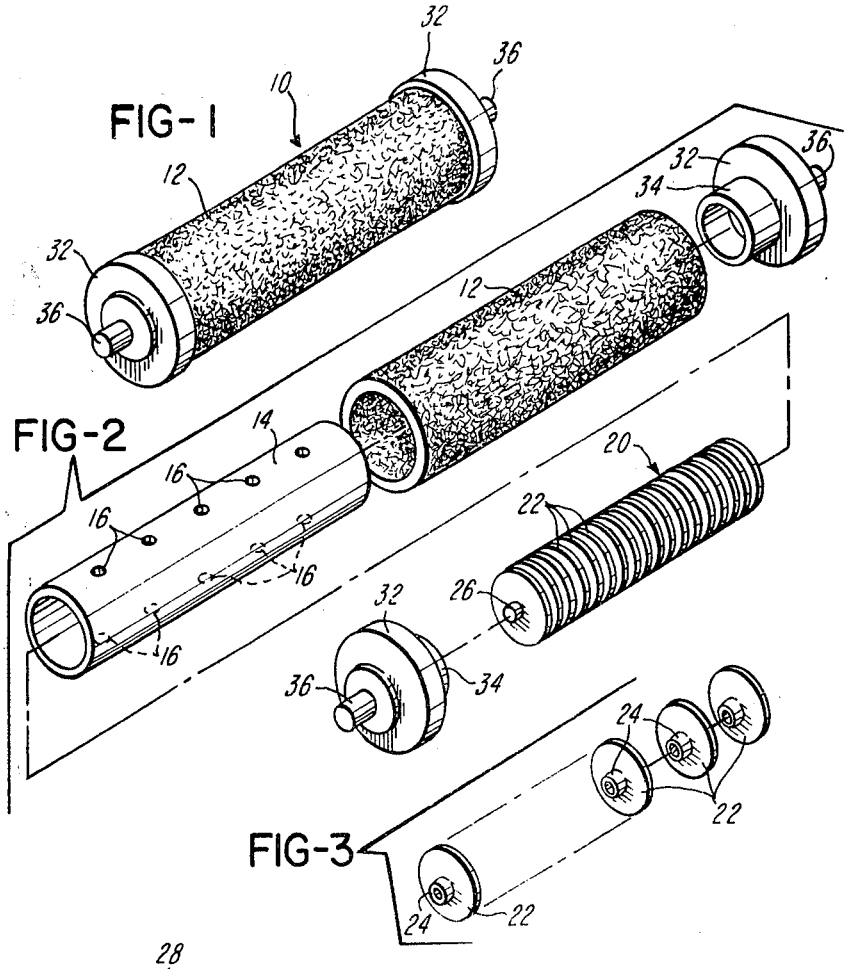
FIG-1
FIG-2
FIG-3
10
12
14
16
20
22
24
26
32
34
36
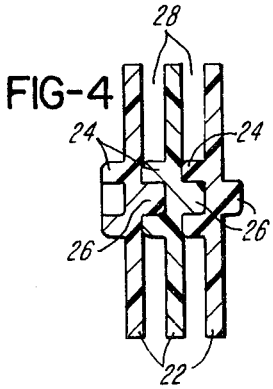
FIG-4
24
26
28
22
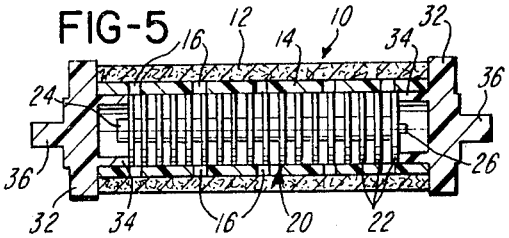
FIG-5
10
12
14
16
20
22
24
26
32
34
36

INK ROLLER ASSEMBLY WITH CAPILLARY INK SUPPLY

This is a division of application Ser. No. 322,459, filed Nov. 18, 1981, now U.S. Pat. No. 4,416,201.

BACKGROUND OF THE INVENTION

In the printing of pressure sensitive labels, for example, with a hand-held portable labeler of the type disclosed in U.S. Pat. No. 4,252,060 which issued to the Assignee of the present invention, it is common to apply ink to the selected printing characters on the endless printing bands or wheels with an ink roller. The ink roller may be of the type which incorporates a micro-porous ink retaining flexible sleeve mounted on a spool for rotation. A supply of ink is carried by the micro-porous sleeve so that the ink roller is capable of supplying sufficient ink to print one or more supply rolls of pressure sensitive labels.

In the printing of labels with characters or codes which are read by optical character recognition equipment, it is important for the printing to meet high quality standards. That is, the labels must be uniformly and precisely printed without a drop off or diminish in printing quality as the supply of ink is consumed from the micro-porous ink roller sleeve. Different forms of ink roller assemblies have been made or proposed in order to incorporate within the ink roller a larger supply of ink, for example, as disclosed in U.S. Pat. Nos. 2,663,257 and 3,738,269. Each of these patents disclose the use of capillary ink retaining passages or chambers within a surrounding band or sleeve of micro-porous ink retaining material.

In such an ink roller assembly, it is desirable to maximize the liquid ink storage capacity of the roller assembly while also providing for optimum flow rate control or metering of the ink from the storage reservoir or chambers to the application sleeve so that the ink applied by the sleeve remains substantially constant or uniform throughout the usable life of the roller assembly. It is also desirable to construct the ink roller assembly in a manner which prevents leakage of ink from the roller assembly in response to sudden changes in temperature or atmospheric pressure. After analyzing the ink roller assemblies disclosed in the above-mentioned patents, it is apparent that these ink roller assemblies do not provide all of the above desirable features.

SUMMARY OF THE INVENTION

The present invention is directed to an improved ink roller assembly which provides all of the desirable features mentioned above and, in addition, is inexpensive and simple in construction. More specifically, the roller assembly of the invention provides for maximizing the ink storage capacity of an ink roller assembly of predetermined size while also providing for a controlled flow rate or metering of the ink to the outer ink application surface of the sleeve in order to provide a substantially uniform or constant ink application rate which does not diminish as the ink supply is being consumed. The capillary action of the ink roller assembly of the invention also eliminates leakage of ink from the assembly when it is subjected to sudden changes in temperature and atmospheric pressure. Thus the ink roller assembly of the invention provides for high efficiency in the utilization of an internal ink supply and provides for precision ink dispensing in order to obtain continuous high quality printing of pressure-sensitive labels and other articles.

In accordance with one embodiment of the invention, an ink roller assembly includes a rigid plastic support tube on which is mounted a resilient and flexible sleeve of micro-porous ink retaining material. An ink retaining and reservoir unit is confined within the support tube and includes a stack of thin plastic discs having an outer diameter slightly less than the inner diameter of the support tube. The thin discs are axially spaced to define therebetween annular capillary chambers for retaining a supply of ink which is metered from the capillary chambers into the porous ink retaining sleeve by a series of axially spaced flow control holes within the plastic support tube. The capillary ink retaining unit is confined within the support tube and the micro-porous sleeve is retained on the tube by a pair of end closure plugs or support members having outwardly projecting journals and cylindrical hub portions which press-fit into opposite ends of the support tube.

Other features and advantages of the invention will be apparent from the following description, the accompanying drawing and the appended claims.

BRIEF DESCRIPTION OF THE DRAWING

FIG. 1 is a perspective view of an ink roller assembly constructed in accordance with the present invention;

FIG. 2 is an exploded perspective view of the components which form the ink roller assembly shown in FIG. 1;

FIG. 3 is an exploded perspective view of the thin plastic discs which form the capillary ink retaining unit shown in FIG. 2;

FIG. 4 is an enlarged axial section of three of the assembled ink retaining discs shown in FIG. 2; and FIG. 5 is an axial section of the ink roller assembly shown in FIG. 1.

DESCRIPTION OF THE PREFERRED EMBODIMENT

FIG. 1 illustrates an ink roller assembly 10 which is constructed in accordance with the invention and which includes a sleeve 12 of flexible and resilient micro-porous ink retaining material. In one test sample of the assembly 10 which provided desirable ink application results, the sleeve 12 had an outer diameter of approximately 0.4 inch and a wall thickness of about 0.050 inch. An elongated rigid support tube 14 is formed or injection molded of a rigid plastics material and has an outer diameter substantially the same as the inside diameter of the sleeve 12. The sleeve 12 and the support tube 14 have the same length, and the support tube 14 is molded with a set of two diametrically opposed rows of axially spaced openings or holes 16 each of which had a diameter of about 0.045 in the test sample.

A capillary ink retaining and reservoir unit 20 extends within the support tube 14 with slight clearance and is constructed from a series of thin molded plastic discs 22. In the test sample, each disc 22 had a thickness of approximately 0.019 inch. Each of the discs 22 includes an annular hub portion 24 which projects from one side of the disc and a cylindrical stud 26 which projects from the opposite side of the disc. As shown in FIG. 4, the stud 26 of each disc 22 is adapted to project into the annular hub 24 of an adjacent disc with a light press-fit, and the assembled discs 22 define therebetween annular capillary chambers 28. In the one test sample, each of the chambers 28 had a width of approximately 0.025 inch.

After the discs 22 are assembled or stacked to form the ink retaining unit 20, the unit is inserted into the rigid support tube 14 and is confined and spaced therein by a pair of end closure support members or plugs 32 each of which has an annular hub portion 34 which press-fits into an end portion of the support tube 14. Each of the support members 32 is also molded of a rigid plastics material and includes an axially or outwardly projecting bearing journal 36. In a conventional manner, the journals 36 are used for rotatably supporting the ink roller assembly 10 so that the outer surface of the ink retaining sleeve 12 may be rolled across the printing faces of the selected printing characters, for example, as disclosed in above-mentioned U.S. Pat. No. 4,252,060.

In order to use the ink roller assembly 10, one of the end closure members or plugs 32 is pulled from the support tube 14, and a supply of ink is added to the support tube 14 until the annular chambers 28 are filled. As a result of the close spacing of the discs 22, the annular chambers 28 provide for capillary retention of the ink within the chambers. A capillary action also exists between the outer cylindrical surfaces of the discs 22 and the inner cylindrical surface of a support tube 14, and a controlled or metered flow of ink flows outwardly from the capillary ink retaining unit 20 through the fine holes 16 and into the micro-porous resilient sleeve 12.

The capillary action which is produced by the ink retaining unit 20 within the surrounding rigid support tube 14 results in supplying ink through the holes 16 and into the micropores within the sleeve 12 at a flow rate which is in direct relation to the transfer of ink from the outer surface of the sleeve 12 to the printing characters. That is, the metering of ink outwardly from the chambers 28 into the sleeve 12 corresponds directly with the use of the ink roller assembly, and the outward flow of ink does not progressively diminish with use of the assembly, as is common with conventional ink rollers. The thinness of the discs 22 also provides for obtaining maximum ink storage capacity within the annular capillary chambers 28 defined by the discs 22 within the support tube 14.

The capillary action produced by the ink retaining unit 20 within the support tube 14 also assures that all of the ink stored within the capillary chambers 28 and within the tube 14 is used by being transferred from the chambers 28 by capillary action into the micropores within the sleeve 12. That is, the capillary action on the liquid ink increases as the size of the capillary spaces or cells decreases, the smaller capillaries within the microporous sleeve 12 attracts the ink from the ink retention unit 20 outwardly through the holes 16 so that substantially all of the ink carried within the support tube 14 is utilized. The strength of the cylindrical support tube 14 also protects the ink retaining unit 20 and prevents the thin discs 22 from being deformed when pressure is applied to the sleeve 12 during the application of ink by the sleeve 12. The press-fit of the end closure support members 32 within the support tube 14 and the small holes 16 surrounded by the sleeve 12 also cooperate to prevent leaking of the ink from the tube 14 when there is a sudden change in atmospheric pressure or temperature.

While the ink roller assembly and its method of construction herein described constitute a preferred embodiment of the invention, it is to be understood that the invention is not limited to the precise form of ink roller described, and that changes may be made therein without departing from the scope and spirit of the invention as defined in the appended claims.

The invention having thus been described, the following is claimed:

1. A method of producing an improved ink roller assembly adapted to provide a uniform application of ink over an extended period of use, comprising the steps of forming an ink retaining unit having axially spaced generally circular walls having integral hub means, said hub means rigidly connecting said series of walls together to define a series of axially spaced annular ink retaining chambers each having a width predetermined by said hub means, inserting the ink retaining unit into a generally rigid cylindrical support tube, mounting a flexible sleeve of porous ink retaining material on the support tube, forming a plurality of openings within the support tube to provide for a controlled flow of ink from the ink retaining chambers outwardly into the sleeve, and forming a set of end closure and support members on opposite ends of the support tube.

2. A method as defined in claim 1 including the step of forming the walls of the ink retaining unit with a thickness less than the spacing between adjacent walls.

3. A method as defined in claim 1 wherein the support tube is formed of a substantially rigid plastics material, and the openings comprise axially spaced holes within the tube.

4. A method as defined in claim 1 and including the step of providing the ink retaining unit with an outer diameter slightly smaller than the inner diameter of the support tube to provide for capillary flow of ink between the ink retaining unit and the support tube and into the openings.

5. A method as defined in claim 1 and including the steps of forming the end closure members with axially projecting cylindrical hub portions, and press-fitting the hub portions of the end closure members into opposite ends of the rigid support tube with the ink retaining unit confined between the hub portions.

6. A method as defined in claim 1 wherein the ink retaining unit is formed by a series of circular discs of plastics material, and connecting the discs in predetermined axially spaced relation to define the ink retaining chambers between adjacent discs.

7. A method as defined in claim 6 and including the step of molding each disc with an axially projecting annular hub portion on one side and a smaller axially projecting stud on the opposite side.

* * * * *